US008555641B2

(12) United States Patent
Lin et al.

(10) Patent No.: US 8,555,641 B2
(45) Date of Patent: Oct. 15, 2013

(54) COOLING DEVICE FOR STIRLING CIRCULATED DRY STORAGE CONTAINER

(75) Inventors: Yan-Ting Lin, Taoyuan County (TW); Pao-Hsiung Chiu, Taoyuan County (TW)

(73) Assignee: Institute of Nuclear Energy Research, Langtan Township, Taoyuan County (TW)

( * ) Notice: Subject to any disclaimer, the term of this patent is extended or adjusted under 35 U.S.C. 154(b) by 170 days.

(21) Appl. No.: 13/292,094

(22) Filed: Nov. 9, 2011

(65) Prior Publication Data

US 2013/0111927 A1 May 9, 2013

(51) Int. Cl.
*G21D 5/00* (2006.01)

(52) U.S. Cl.
USPC ..... 60/644.1; 60/520; 62/60

(58) Field of Classification Search
USPC ..... 60/644.1, 520, 525; 62/60
See application file for complete search history.

(56) References Cited

U.S. PATENT DOCUMENTS

| | | | | |
|---|---|---|---|---|
| 4,434,617 | A * | 3/1984 | Walsh | 60/520 |
| 5,753,925 | A * | 5/1998 | Yamanaka et al. | 250/507.1 |
| 6,183,243 | B1 * | 2/2001 | Snyder | 432/28 |
| 7,043,909 | B1 * | 5/2006 | Steele | 60/517 |
| 7,772,746 | B2 * | 8/2010 | Keolian et al. | 310/339 |
| 8,135,107 | B2 * | 3/2012 | Singh et al. | 376/272 |
| 2010/0284506 | A1 * | 11/2010 | Singh | 376/272 |
| 2012/0037632 | A1 * | 2/2012 | Singh et al. | 220/367.1 |

* cited by examiner

*Primary Examiner* — Thomas Denion
*Assistant Examiner* — Shafiq Mian

(57) ABSTRACT

A cooling device for Stirling circulated dry storage container, which is mainly to make an accommodation space with opening within an external shield, and at the peripherals of the accommodation space, it is installed with a plurality of air flow inlets and air flow outlets that are connected to the external side. In addition, a shield cover is used to cover the opening of the accommodation space, and a nuclear waste storage container is installed within the accommodation space of the external shield, and the peripheral of the accommodation space and the nuclear waste storage container forms an air flow channel.

9 Claims, 4 Drawing Sheets

COOLING DEVICE FOR STIRLING CIRCULATED DRY STORAGE CONTAINER

BACKGROUND OF THE INVENTION

1. Field of the Invention

The present invention relates to a cooling device of Stirling circulated dry storage container, and it specifically means a cooling device that does not need the additional supply of power, has economic efficiency, and can operate stably for a long time.

2. Description of the Prior Art

For the processing of high radiation level waste such as used nuclear fuel, currently in the world's nuclear electricity industry for the initial stage (within five years), spent fuel pool is adopted to accommodate the high radiation level waste; however, after five years, it enters the medium processing stage, and the medium processing stage can be divided into wet storage and dry storage methods. In the wet storage method, high level radiation waste is continuously placed in the cooling system of spent fuel pool so as to use the same method to cool continuously the high level radiation waste, however, in dry cask storage, since the decay heat of the high radiation level waste has been reduced to a level that air convection cooling can be used as a cooling way, and the used fuel is then stored in the cask for cooling.

However, after Mar. 11, 2011, for the Fukushima nuclear plant of Japan, strong earthquake has caused the loss of cooling circulation power in the cooling water of the used fuel pool, and the fuel rods thus got melted and H2 generation is triggered due to the dissolution of Zirconium alloy, hence, people start doubting about the wet storage method which uses the fuel pool for the cooling; hence, after long term cooling of the used fuel rods in the fuel pool, the fuel rods are moved out, and dry storage method is adopted next for the rest of the storage, and this has become the major promotional policy of the nuclear industry in countries around the world.

However, in the above dry storage method, if a low power consumption and stable driving mechanism can be associated to generate sufficient air convection, then a better heat dissipation and temperature reducing effect can be reached, however, among lots of design structures, Stirling heat engine is no doubt a structure that absolutely meets the needed characteristic; currently, for the application of Stirling temperature difference circulation engine to a specific heat source environment, it contains the following different embodiments:

Currently in the US patents, there is no patent regarding the use of Stirling circulation to reach the goal of heat dissipation of used nuclear fuel dry storage system, however, there is a U.S. Pat. No. 5,753,925, which disclosed the design of Radioactive waste storage facility, in that patent, facility type management is adopted to store all the dry containers in the plant, then cold air is used for heat dissipation. However, it is an active heat dissipation system, which needs a driving device.

In addition, in disclosed patent of Republic of China of number 200829144 (application no. of 095149054), an invention patent of "Electronic device and its heat dissipation module" is disclosed, which discloses the structures of heat dissipation module that mainly comprises of: heat conductive substrate, heat dissipation fin, electric fan and Stirling engine; moreover, the heat conductive substrate is installed on the heat source, and heat dissipation fin is connected to heat conductive substrate, meanwhile, the air outlet direction of the electric fan heads towards the heat dissipation fin. Stirling engine has a power input end and a power output end, and power input end is installed on heat conductive substrate, power output end is connected to electric fan so as to use the thermal energy generated by the heat source to drive the Stirling engine, then the Stirling engine will drive the electric fan to do heat dissipation on the heat source. However, during the real application of this structure, since the peripheral is an open space, the electric fan that is driven by Stirling engine will not have good air circulation path during its operation, turbulent effect could easily be generated to affect the entire heat dissipation efficiency.

Therefore, to solve the above drawbacks of the heat dissipation device of the prior art as driven by Stirling engine, the inventor thus provides a way of improvement that leads to the generation of the present invention.

SUMMARY OF THE INVENTION

The main objective of the present invention is to provide a cooling device for a Stirling circulated dry storage container. It uses the residual heat of high radiation level waste as the heat source, and the temperature difference between this heat source and the external side is used to drive Stirling engine, meanwhile, the Stirling engine is used to drive the rotation of the vane of the pre-installed electric fan, which in turn will bring up the air flow in the neighborhood so as to enhance the entire heat dissipation efficiency.

Another objective of the present invention is to provide a cooling device for Stirling circulated dry storage container, which can fully use the residual heat generated by the high radiation level waste to drive the Stirling engine, hence, it is not necessary to provide additional electrical energy, and it thus has very good economic efficiency; in the mean time, Stirling engine can operate stably for a long time, and it has excellent reliability too.

To achieve the above objective and function, the technical means adopted in the present invention includes: an external shield, which is installed with an accommodation space having opening on the top side, meanwhile, at the peripheral of the bottom of the accommodation space, it is installed with a plurality of air flow inlets connected externally, furthermore, at the peripheral on the top side of the accommodation space, it is installed with a plurality of air flow outlets connected externally, in addition, there is a shield cover that is put on the opening of the accommodation space; a nuclear waste storage container is installed within the accommodation space of the external shield, meanwhile, at the peripheral of the nuclear waste storage container, an air flow path for air circulation is naturally formed; a Stirling heat engine is installed within the accommodation space of the external shield and is in contact with the nuclear waste storage container; moreover, at the peripheral of the Stirling heat engine, it is installed with a plurality of electric fans, the Stirling heat engine will then receive heat dissipated by the nuclear waste storage container to drive the operation of the electric fans and to generate air flow for continuous heat dissipation.

According to the above structure, the nuclear waste storage container is installed with a high temperature outlet; meanwhile, the nuclear waste storage container is in contact with the high temperature outlet.

According to the above structure, the high temperature outlet is installed at one side of air flow outlet of the external shield that is close to the nuclear waste storage container.

According to the above structure, the electric fans are connected to the respective air flow outlets.

According to the above structure, a plurality of electrical fans are centrifugal fans installed at the peripheral of Stirling heat engine in radiated shape.

According to the above structure, each air flow outlet extends along the tangent direction at the peripheral of accommodation space.

According to the above structure, each air flow inlet extends along the radiated direction at the peripheral of the accommodation space.

According to the above structure, the bottom of the external shield is installed with a bottom shield.

According to the above structure, at the center of the shield cover, it is installed with a protruding part that is extended into the accommodation space.

For the detailed structure, application principle, function and effectiveness of the present invention, please refer to the descriptions of the following drawings to get full understanding:

DETAILED DESCRIPTION OF THE PREFERRED EMBODIMENT

Figure 1:
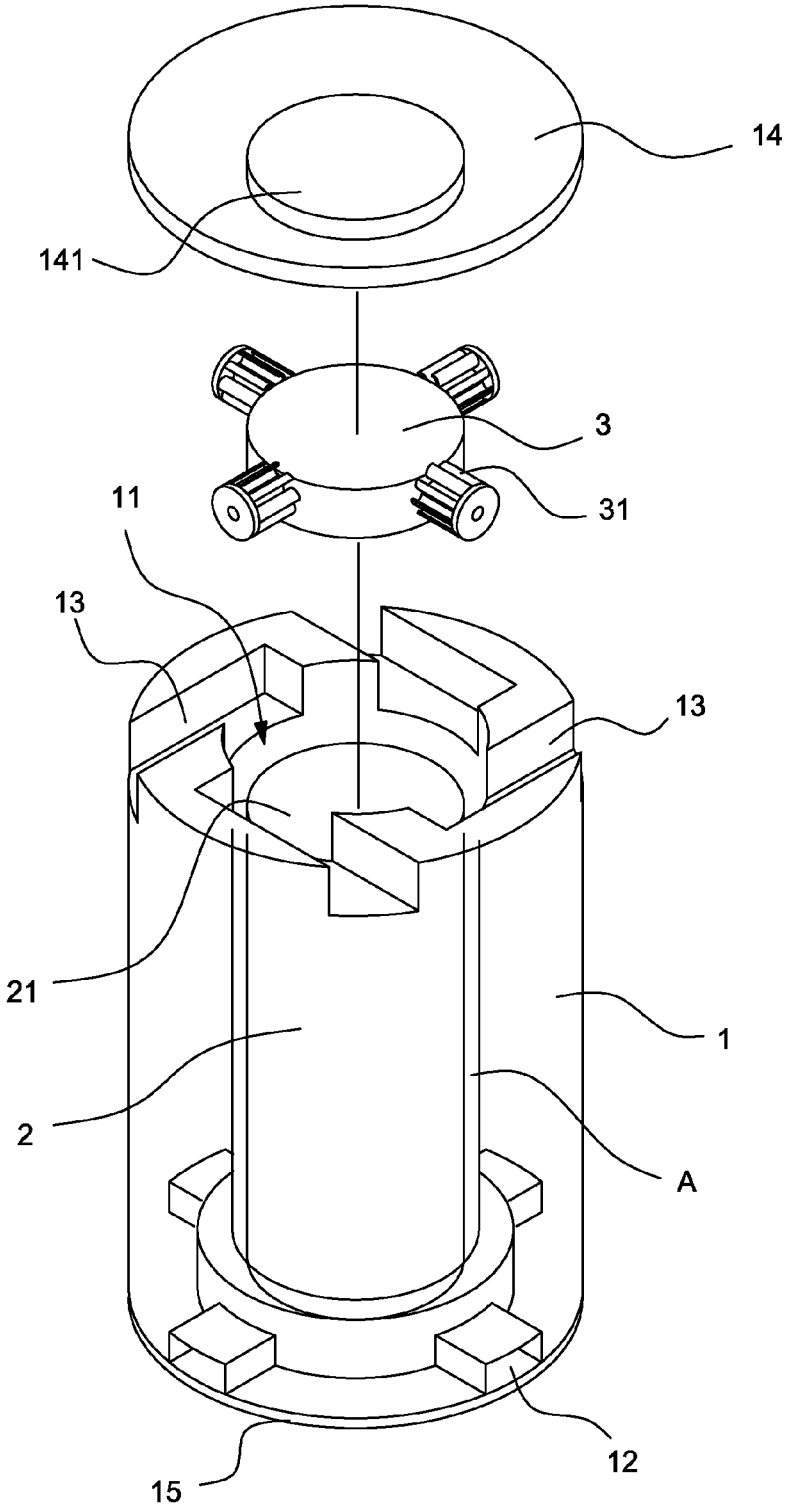
FIG. 1 is structural decomposition of the present invention.
Figure 2:
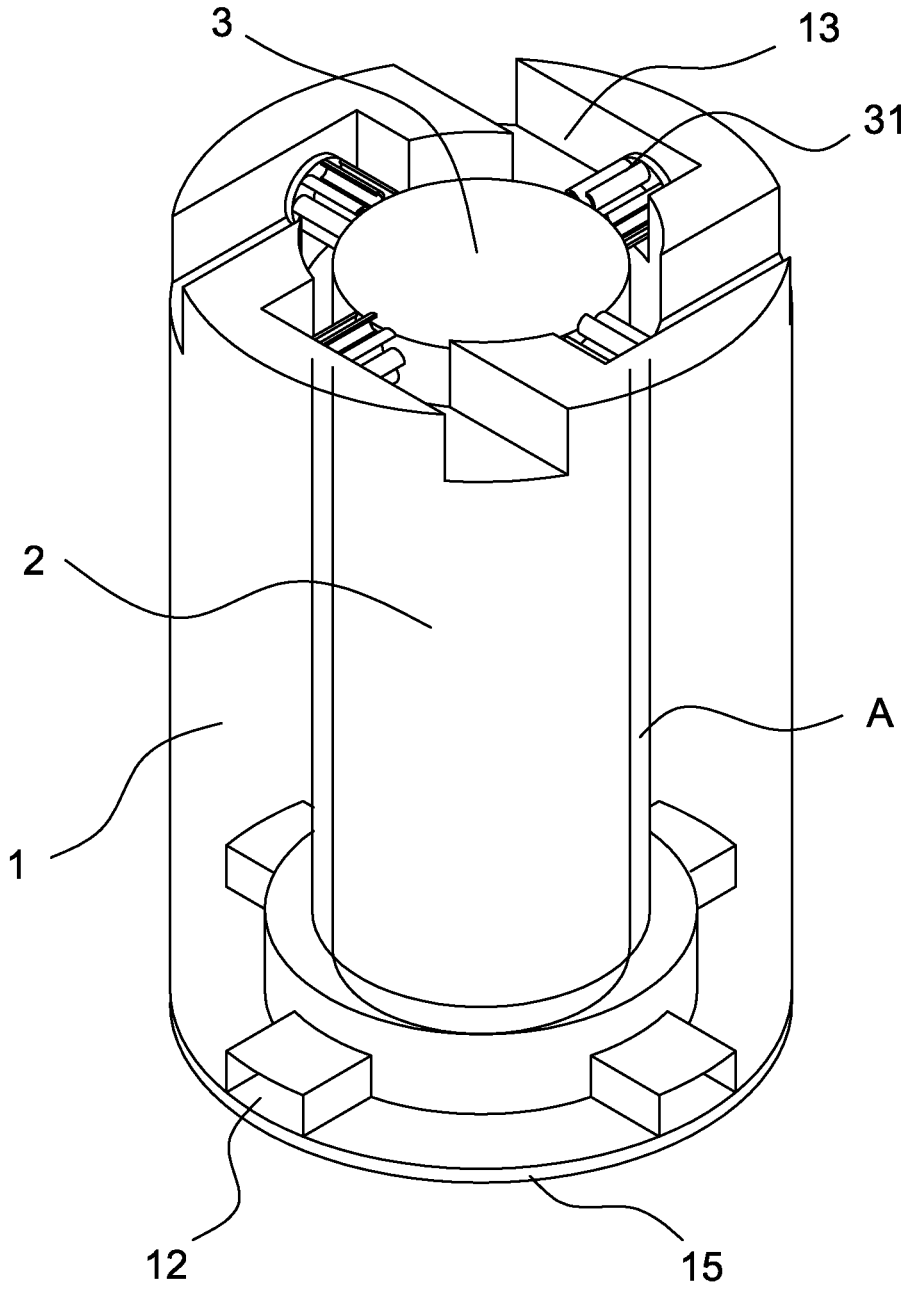
FIG. 2 illustrates the partial assembly of the present invention.
Figure 3:
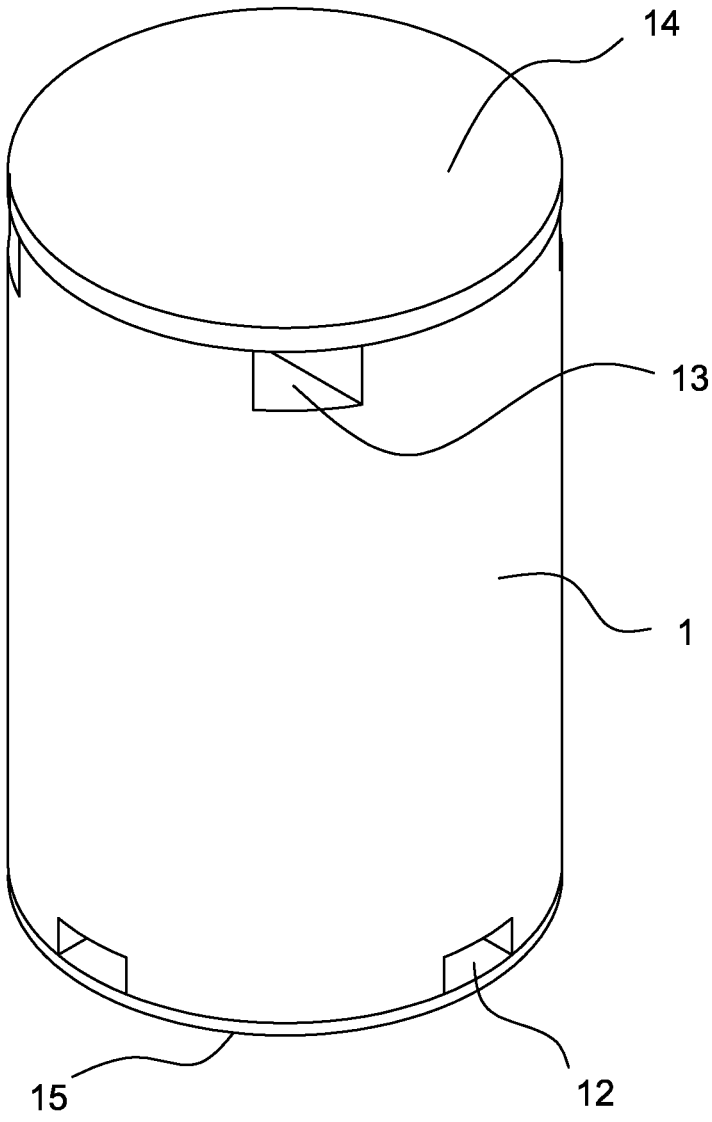
FIG. 3 is the outline drawing of the entire assembly of the present invention.

By referring to FIGS. 1 to 3, it can be seen that the structures of the present invention mainly include:

External shield 1, nuclear waste storage container 2 and Stirling heat engine 3; wherein external shield 1 is structural body that is precast by cement, at its inside, it is installed with accommodation space 11 that has opening on the top side, at the peripheral of the bottom of the accommodation space 11, it is installed with a plurality of air flow inlets 12 that extend in radiated way to the external side, at the peripheral of the top side of accommodation space 11, it is installed with a plurality of air flow outlets 13 that extend along the tangent direction to the external side; in addition, a cement precast shield cover 14 can cover on the opening of the accommodation space 11, and at the center of the shield cover 14, it is installed with a protruding part 141 that can extend into accommodation space 11, and at the bottom surface of the external shield 1, it is installed with a steel-formed bottom shield 15, and nuclear waste storage container 2 is installed within accommodation space 11 of the external shield 1; moreover, between the peripheral of the nuclear waste storage container 2 and the accommodation space 11, an air flow path A for the air circulation is formed, and at the top side of the nuclear waste storage container 2, close to one side of the air flow outlet 13, it is installed with a high temperature outlet 21, and Stirling heat engine 3 is installed within the accommodation space 11 of the external shield 1, and is in contact with the high temperature outlet 21 of the nuclear waste storage container 2, furthermore, at the peripheral of the Stirling heat engine 3, it is installed with a plurality of centrifugal electrical fans 31 that are installed in radiated way, and each electrical fan 31 can be connected to each air flow outlet 13.

Figure 4:
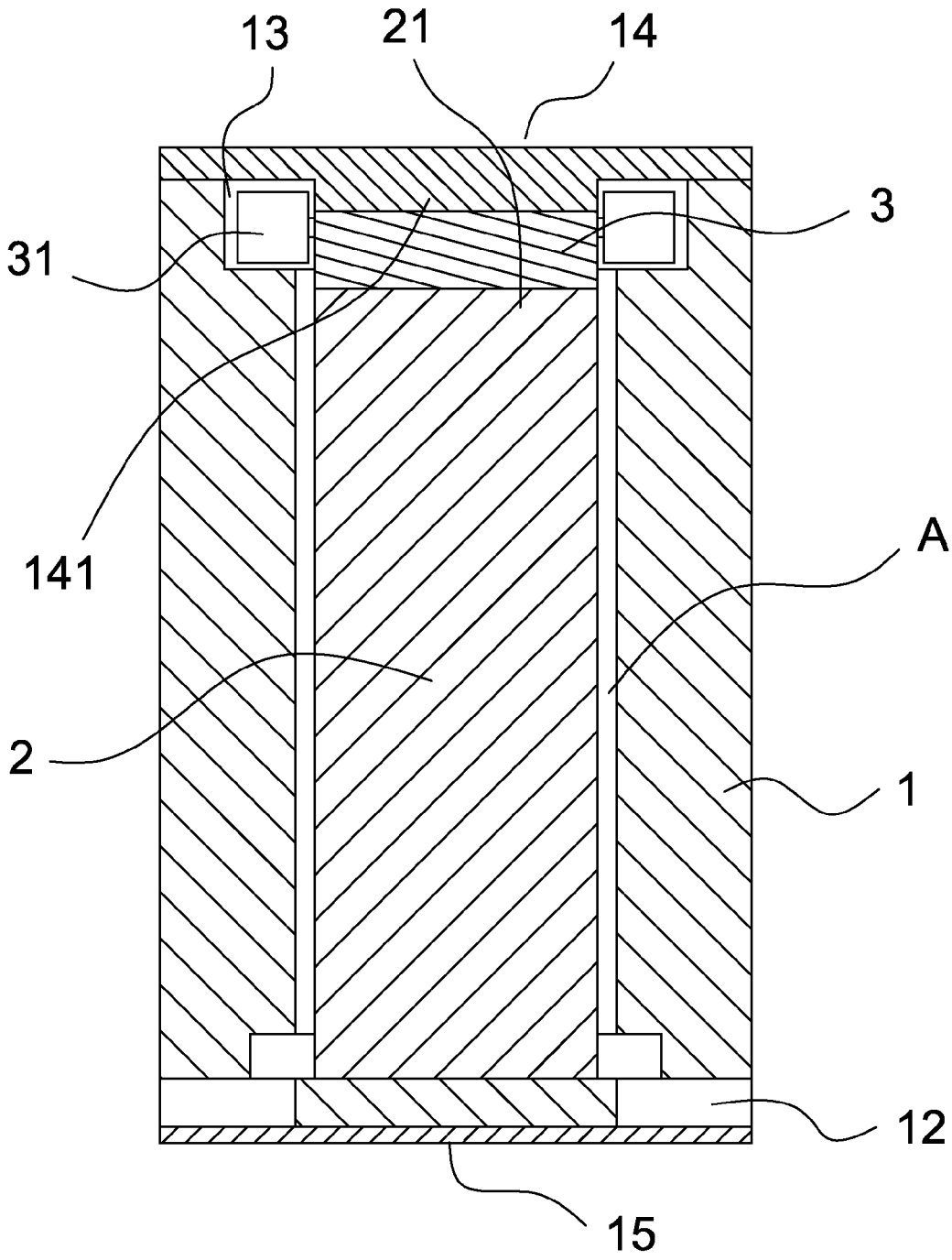
FIG. 4 is the cross sectional view of the entire assembly of the present invention.

By referring to FIG. 4, it can be seen that during the practical application of the above structure of the present invention, the Stirling heat engine 3 can receive directly the heat dissipated by the nuclear waste storage container 2 through the high temperature outlet 21, and the operation of the centrifugal electrical fans 31 can then be driven so as to expel the air in accommodation space 11 through each air flow outlet 13, at this moment, negative pressure will be generated automatically within accommodation space 11, then through each air flow inlet 12, the external air is sucked in, hence, in the air flow path A at the peripheral of the nuclear waste storage container 2, heat dissipation flow moving from air flow inlet 12 to air flow outlet 13 can then be formed.

In the above structure of the present invention, it uses directly the temperature difference between the decay heat of nuclear fuel and the external temperature to drive the Stirling engine so as to convert the decay heat into mechanical work to drive the electrical fan 31; through the peripheral air flow brought about by electrical fan 31, in addition to enhancing the air circulation and cooling performance on nuclear waste storage container 2, it can also maintain the temperature of the low temperature end of Stirling heat engine 3, hence, without external energy input, without external wind force and under bad convective condition, continuous self-cooling effect can still be generated.

From the above statement, it can be seen that the cooling device of Stirling circulated dry storage container of the present invention indeed has economic, environmental protection and stable operation effectiveness, hence, it has utility, novelty and progressiveness to be used in the industry.

However, the above case is only a better embodiment of the present invention, which is not used to limit the embodied scope of the present invention. Therefore, any equivalent change and modification according to what is claimed of the present invention should all fall within what is claimed.

What is claimed is:

1. A cooling device for Stirling circulated dry storage container comprising:

an external shield installed with accommodation space having an opening in the top side, a plurality of air flow inlets connected to the external side being installed at the peripheral of the bottom of the accommodation space, and a plurality of air flow outlets connected to the external side being installed on the peripheral at the upper side of accommodation space, and a shield cover provided on the opening of the accommodation space;

a nuclear waste storage container installed within the accommodation space of the external shield, and an air flow path for air circulation formed at the peripheral of the nuclear waste storage container;

a Stirling heat engine installed within the accommodation space of the external shield in contact with the nuclear waste storage container; and a plurality of electrical fans installed at the peripheral of the Stirling heat engine, and heat dissipated by the nuclear waste storage container being received through the Stirling heat engine and dissipated by air flow generated by the electrical fans.

2. The cooling device for Stirling circulated dry storage container of claim 1, wherein the nuclear waste storage container is installed with one high temperature outlet, and the nuclear waste storage container is in contact with the high temperature outlet.

3. The cooling device for Stirling circulated dry storage container of claim 2, wherein the high temperature outlet is installed at one side of nuclear waste storage container that is close to air flow outlet of the external shield.

4. The cooling device for Stirling circulated dry storage container of claim 1, wherein each electrical fan is connected to each air flow outlet.

5. The cooling device for Stirling circulated dry storage container of claim 4, wherein the plurality of electrical fans are centrifugal electrical fans installed at the peripheral of the Stirling heat engine in radiated way.

6. The cooling device for Stirling circulated dry storage container of claim 5, wherein each air flow outlet extends on the peripheral of accommodation space in tangential line direction.

7. The cooling device for Stirling circulated dry storage container of claim 6, wherein each air flow inlet extends on the peripheral of accommodation space in radiated direction.

8. The cooling device for Stirling circulated dry storage container of claim 1, wherein the bottom face of the external shield is installed with a bottom shield.

9. The cooling device for Stirling circulated dry storage container of claim 1, wherein the center of the shield cover is installed with a protruding part extending into accommodation space.

* * * * *